US011401669B2

(12) United States Patent
Kulp et al.

(10) Patent No.: US 11,401,669 B2
(45) Date of Patent: Aug. 2, 2022

(54) TRAFFIC SIGN MOUNTABLE ON A TRAFFIC CONE

(71) Applicant: TRAFFIX DEVICES, INC., San Clemente, CA (US)

(72) Inventors: Jack H. Kulp, Dana Point, CA (US); Geoffrey B. Maus, Mission Viejo, CA (US); Brent M. Kulp, San Clemente, CA (US); Felipe Almanza, San Clemente, CA (US); Christopher Jaime, San Clemente, CA (US)

(73) Assignee: TRAFFIX DEVICES, INC., San Clemente, CA (US)

( * ) Notice: Subject to any disclaimer, the term of this patent is extended or adjusted under 35 U.S.C. 154(b) by 954 days.

(21) Appl. No.: 16/168,696

(22) Filed: Oct. 23, 2018

(65) Prior Publication Data

US 2019/0119869 A1 Apr. 25, 2019

Related U.S. Application Data

(60) Provisional application No. 62/649,311, filed on Mar. 28, 2018, provisional application No. 62/575,654, filed on Oct. 23, 2017.

(51) Int. Cl.

| | |
|---|---|
| ***E01F 9/658*** | (2016.01) |
| ***E01F 9/688*** | (2016.01) |
| ***E01F 9/654*** | (2016.01) |

(52) U.S. Cl.

CPC ..... *E01F 9/658* (2016.02); *E01F 9/654* (2016.02); *E01F 9/688* (2016.02)

(58) Field of Classification Search

CPC ..... E01F 9/658; E01F 9/654; E01F 9/688

See application file for complete search history.

(56) References Cited

U.S. PATENT DOCUMENTS

| | | | | | |
|---|---|---|---|---|---|
| 1,532,575 | A * | 4/1925 | Camden | E01F 9/65 | 40/479 |
| 4,019,271 | A * | 4/1977 | Latimer | G09F 15/0037 | 40/603 |
| 4,197,808 | A * | 4/1980 | Kinninger | G09F 7/20 | 116/63 C |
| 4,511,281 | A * | 4/1985 | Schmanski | E01F 9/602 | 404/10 |
| 4,611,949 | A * | 9/1986 | Schmanski | E01F 13/06 | 404/10 |
| 4,772,869 | A * | 9/1988 | Grammas | B60Q 7/00 | 116/63 C |
| 5,195,453 | A * | 3/1993 | McGibbon, II | E01F 9/688 | 116/63 C |
| 5,269,251 | A * | 12/1993 | Freeman | E01F 9/617 | 116/63 C |

(Continued)

FOREIGN PATENT DOCUMENTS

| | | | | |
|---|---|---|---|---|
| CH | 616975 A5 * | 4/1980 | ..... | E01F 9/617 |
| FR | 2997971 A1 * | 5/2014 | ..... | E01F 9/688 |

*Primary Examiner* — Nimeshkumar D Patel
*Assistant Examiner* — Tania Courson
(74) *Attorney, Agent, or Firm* — Donald E. Stout; Stout, Uxa & Buyan, LLP

(57) ABSTRACT

A sign system snaps for displaying informational or warning information to passing motorists or pedestrians is designed to be snapped on and interferingly engaged with the top end of a traffic marker or cone.

28 Claims, 9 Drawing Sheets

(56) References Cited

U.S. PATENT DOCUMENTS

| | | | | |
|---|---|---|---|---|
| 5,888,016 | A * | 3/1999 | Ahn | E01F 9/619 404/10 |
| 6,427,964 | B1 * | 8/2002 | Hillstrom | G09F 15/0062 248/314 |
| 6,536,369 | B1 * | 3/2003 | Bent | E01F 9/688 116/173 |
| 6,659,681 | B1 * | 12/2003 | Kulp | E01F 9/573 116/63 P |
| 7,350,328 | B1 * | 4/2008 | Garcia | G09F 15/0062 116/63 P |
| 8,631,755 | B2 * | 1/2014 | Klein | E01F 9/658 116/630 |
| 8,777,512 | B2 * | 7/2014 | Henderson | E01F 13/02 404/9 |
| 9,347,189 | B2 * | 5/2016 | Eccless | E01F 9/688 |
| 9,360,157 | B1 * | 6/2016 | Schwetz | E01F 9/669 |
| 9,797,102 | B2 | 10/2017 | Maus et al. | |
| 9,988,777 | B2 * | 6/2018 | Lee | E01F 9/608 |
| 10,422,090 | B2 * | 9/2019 | Maus | E01F 9/654 |
| 2002/0073912 | A1 * | 6/2002 | Kuo | E01F 9/629 116/63 P |
| 2008/0295375 | A1 * | 12/2008 | Intagliata | E01F 9/629 40/608 |
| 2019/0249381 | A1 * | 8/2019 | Crawley | E01F 13/028 |

* cited by examiner

TRAFFIC SIGN MOUNTABLE ON A TRAFFIC CONE

This application claims the benefit under 35 U.S.C. 119(e) of the filing date of Provisional U.S. Application Ser. No. 62/575,654, entitled Traffic Sign Mountable on a Traffic Cone, filed on Oct. 23, 2017, and also of the filing date of Provisional U.S. Application Ser. No. 62/649,311, entitled Traffic Sign Mountable on a Traffic Cone, filed on Mar. 28, 2018. Both of the foregoing applications are commonly assigned with the present application, and are each expressly incorporated herein by reference, in their entirety.

BACKGROUND OF THE INVENTION

The present invention relates generally to traffic signs used to alert or divert vehicles, pedestrians, and the like, and more particularly to traffic signs for temporary use which are mountable on a traffic cone or other traffic marker device.

A traffic cone or marker device of the general type contemplated herein to serve as a mounting base for the inventive traffic sign is disclosed in commonly assigned U.S. Pat. No. 9,797,102, issued on Oct. 24, 2017, which patent is herein expressly incorporated by reference, in its entirety.

SUMMARY OF THE INVENTION

The inventive sign system snaps onto the top end of a traffic marker or cone, such as the plastic cone disclosed in U.S. Pat. No. 9,797,102, referenced above, and sold by the Applicant under the registered trademark ENVIRO-CONE®.

More particularly, in one aspect of the invention there is provided a sign system for displaying warning or informational messages, which comprises a sign portion having an outer frame defining a panel on which may be displayed an informational or warning message, and a mounting post extending downwardly from a bottom portion of the outer frame, for securing the sign portion to a top end of a traffic marker. A plurality of protrusions are disposed about a periphery of the mounting post, which are adapted to engage a portion of a marker body wall on the top end of the traffic marker for securing the sign portion to the traffic marker. The sign portion may comprise molded plastic, such as low density polyethylene.

The plurality of protrusions are adapted to create a secure interfering fit between the mounting post and the traffic marker when the plurality of protrusions engage the marker body wall.

In one embodiment, the mounting post comprises a lower opening, and the lower opening of the mounting post is adapted to slide over the top end of the traffic marker to secure the sign portion to the traffic marker. The mounting post has a circumferential periphery defining the lower opening, and is generally conically shaped such that the mounting post has a greater diameter at its lower end than at an upper end thereof, the plurality of protrusions extending about the circumferential periphery of the mounting post and protruding inwardly from the circumferential periphery, the inwardly protruding protrusions interferingly engaging with the top end of the traffic marker as the mounting post is slid downwardly over the traffic marker to secure the sign portion in place on the traffic marker.

In another embodiment, the mounting post comprises a tapered plug, having a greater diameter at an upper end and a lesser diameter at a lower end thereof. The plurality of protrusions comprise a plurality of spaced circumferential teeth disposed about the tapered plug. The spaced circumferential teeth may comprise circumferential angled teeth. One or a plurality of flattened portions may be disposed across a plurality of the spaced circumferential teeth, the flattened portions enhancing a secure interfering fit between the tapered plug and the traffic marker.

A plurality of brace members connect the outer frame to the mounting post, the brace members each having a mounting aperture disposed therein.

In another aspect of the invention, there is provided a sign system for displaying warning or informational messages, which comprises a sign portion having an outer frame defining a panel on which may be displayed an informational or warning message, a traffic marker having a top end and a marker body wall, and a mounting post extending downwardly from a bottom portion of the outer frame which secures the sign portion to the top end of the traffic marker. A plurality of protrusions are disposed about a periphery of the mounting post, which engage a portion of the marker body wall on the top end of the traffic marker and secure the sign portion to the traffic marker. The sign portion may comprise molded plastic, such as low density polyethylene. The plurality of protrusions create a secure interfering fit between the mounting post and the traffic marker when the plurality of protrusions engage the marker body wall.

In one embodiment the mounting post comprises a lower opening, wherein the lower opening of the mounting post is slid over the top end of the traffic marker to secure the sign portion to the traffic marker. The mounting post has a circumferential periphery defining the lower opening, and is generally conically shaped such that the mounting post has a greater diameter at its lower end than at an upper end thereof, the plurality of protrusions extending about the circumferential periphery of the mounting post and protruding inwardly from the circumferential periphery, the inwardly protruding protrusions interferingly engaging with the top end of the traffic marker as the mounting post is slid downwardly over the traffic marker to secure the sign portion in place on the traffic marker.

In another embodiment, the mounting post comprises a tapered plug, having a greater diameter at an upper end and a lesser diameter at a lower end thereof. The plurality of protrusions comprise a plurality of spaced circumferential teeth disposed about the tapered plug. The spaced circumferential teeth may comprise circumferential angled teeth. A flattened portion is disposed across a plurality of the spaced circumferential teeth, the flattened portion enhancing a secure interfering fit between the tapered plug and the traffic marker. The flattened portion may comprise a plurality of flattened portions. A plurality of brace members connect the outer frame to the mounting post, the brace members each having a mounting aperture disposed therein.

In still another aspect of the invention, there is disclosed a method of securing a sign system for displaying warning or informational messages to a top end of a traffic marker, which comprises steps of moving a mounting post disposed on a lower end of a sign frame downwardly into engagement with a top end of a traffic marker body, and securing the mounting post to the traffic marker body by interferingly engaging protrusions disclosed on the mounting post with a marker body wall defining the top end of the traffic marker.

In one approach, the moving step comprises inserting the top end of the marker body into a lower opening on the mounting post, so that the mounting post is disposed over the top end of the marker body, and further wherein the securing step comprises engaging protrusions disposed on an inner surface of the mounting post above the lower opening with the marker body wall. In another approach, the moving step comprises inserting a tapered plug into an opening in the top end of the marker body, and further wherein the securing step comprises engaging circumferential threads disposed on the tapered plug with portions of the marker body defining the top end opening thereof.

The invention, together with additional features and advantages thereof, may best be understood by reference to the following description taken in conjunction with the accompanying illustrative drawings.

DETAILED DESCRIPTION OF THE INVENTION

Figure 1:
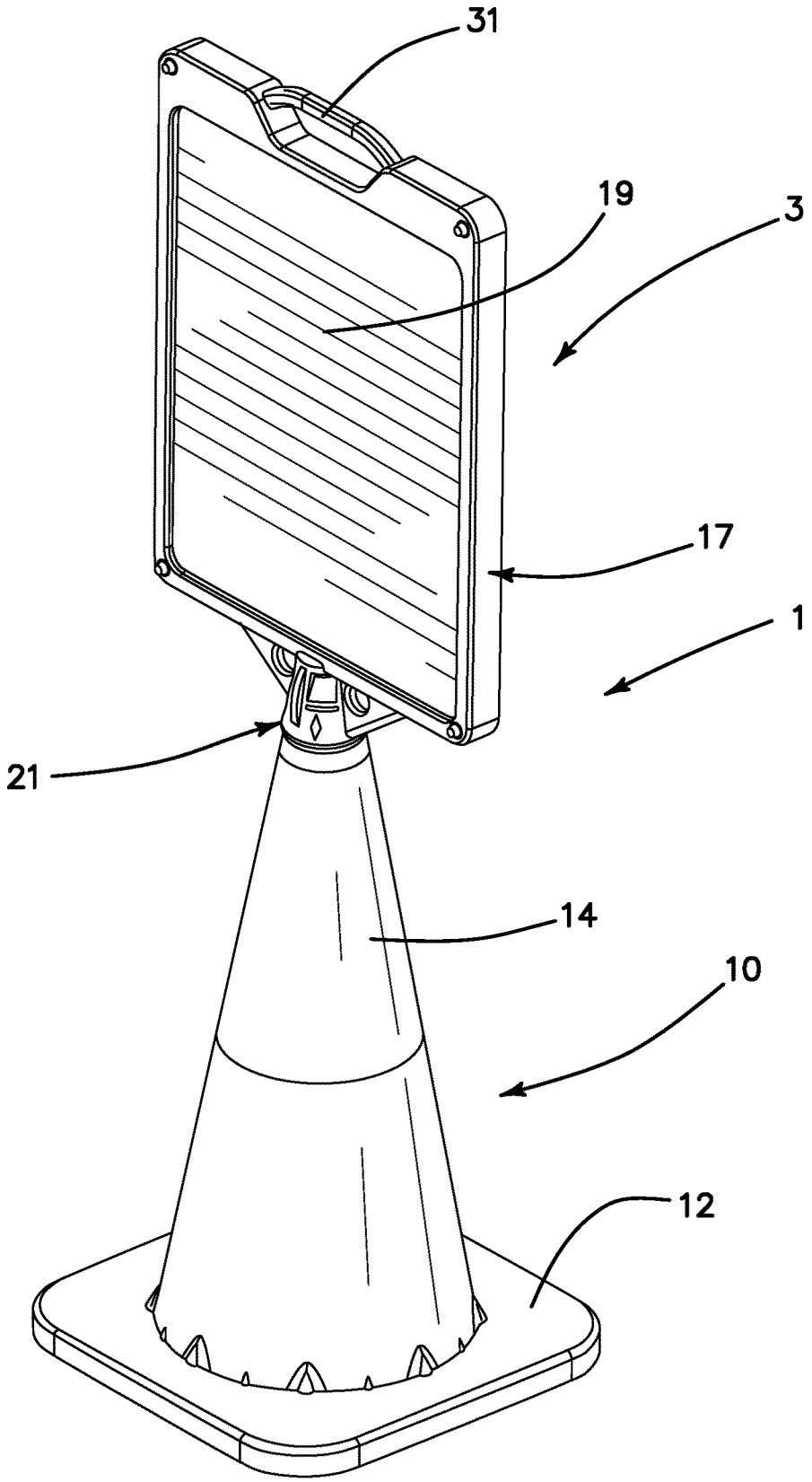
FIG. 1 is an isometric view of a traffic sign mounted on a traffic cone in accordance with one exemplary embodiment of the invention.
Figure 2:
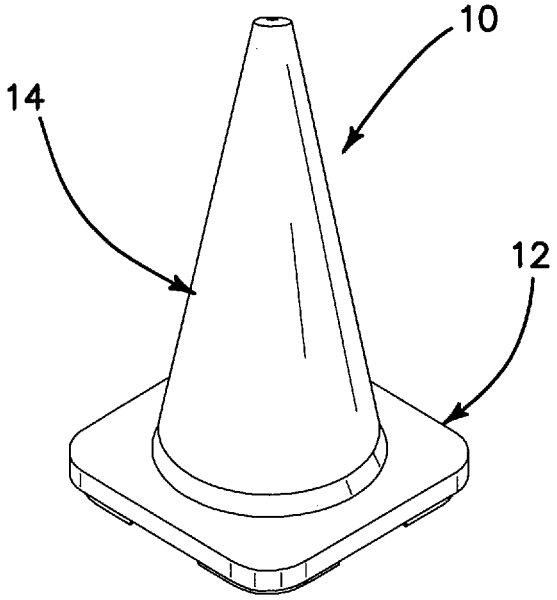
FIG. 2 PRIOR ART
FIG. 2 is an isometric view of an exemplary prior art traffic cone for use with the traffic sign of the present invention.
Figure 3:
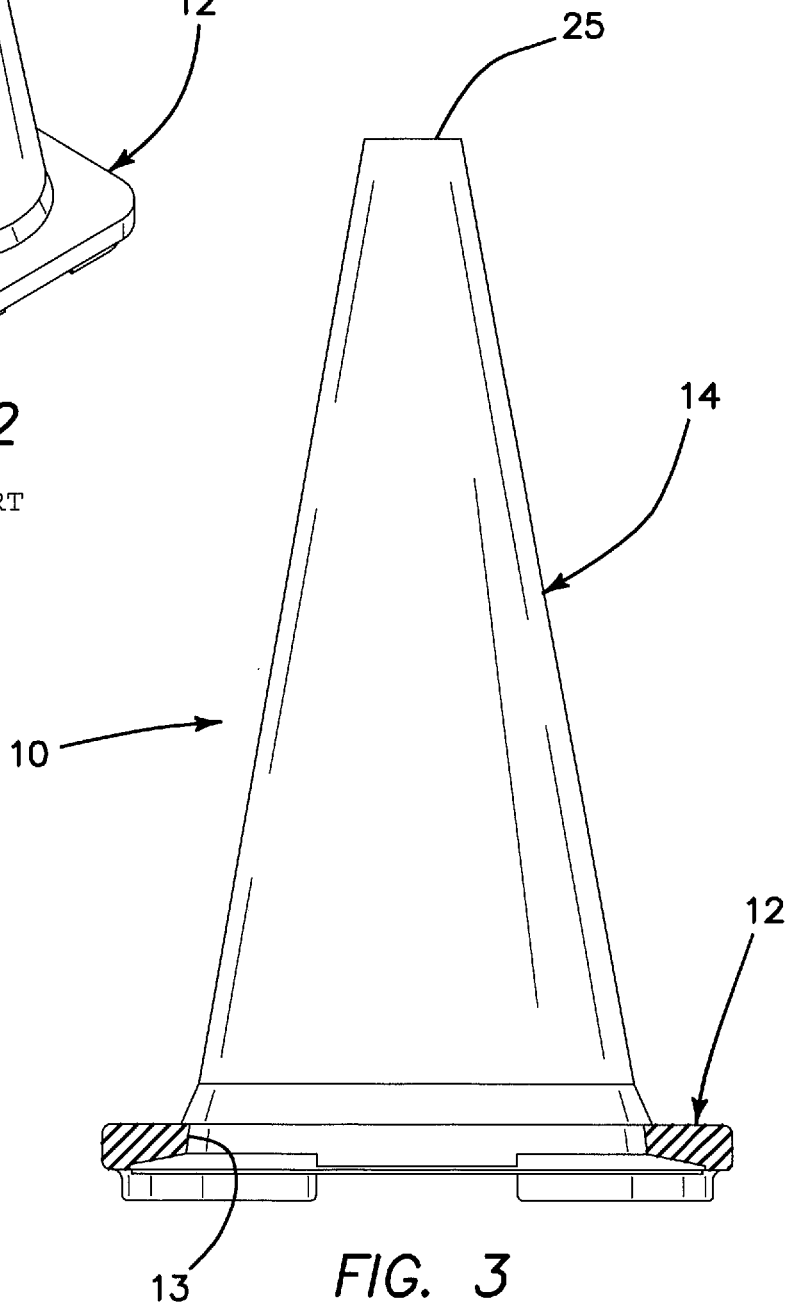
FIG. 3 PRIOR ART
FIG. 3 is a cross-sectional view of the prior art traffic cone of FIG. 2.
Figure 11:
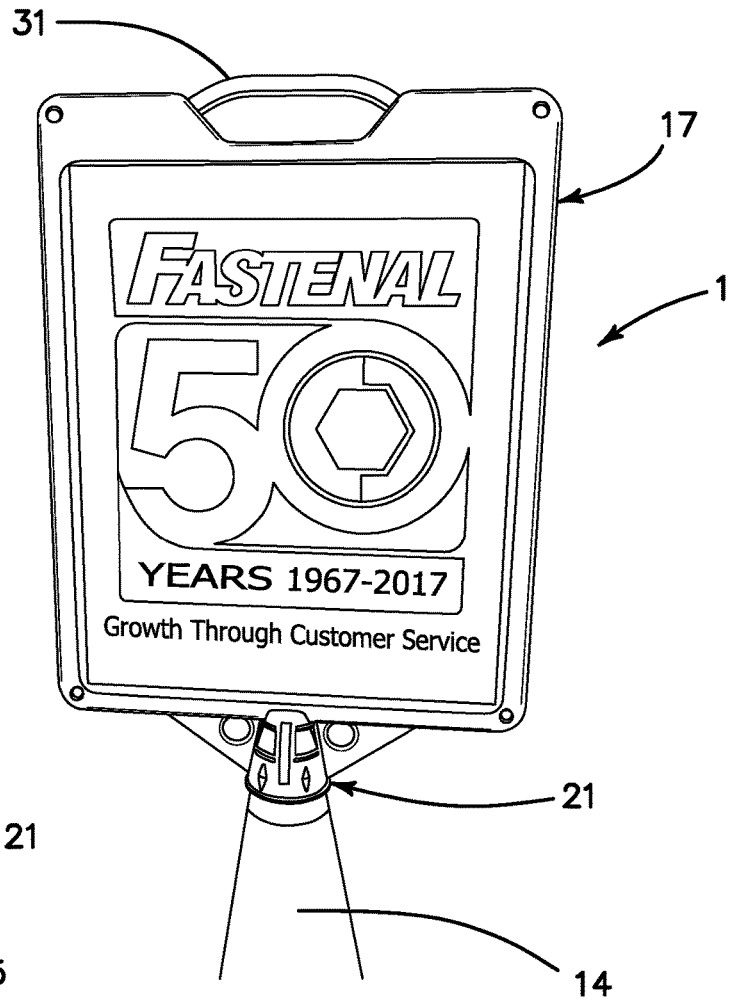
FIG. 11 is a view similar to FIG. 1 showing a sign constructed in accordance with an exemplary embodiment of the present invention.

Referring now more particularly to the drawings, there is shown in FIGS. 1 and 11 an exemplary embodiment of a traffic sign assembly 1, comprising a traffic sign 3 which is attached to a top end of a traffic cone assembly 10. The traffic cone assembly 10, illustrated in FIGS. 2-5, comprises a molded base 12 connected to a marker body 14, which, as illustrated, is conically shaped. The molded base 12 has a center aperture 13 (FIG. 3). The marker body 14 need not necessarily be conical in shape, though this conventional traffic marker shape is presently preferred.

The cone body 14 is preferably injection molded or blow molded of low density polyethylene or other suitable plastic. This material selection provides superior cold weather performance. It may also be molded of a blend, in whole or in part, of both high density and low density material. The base 12 is molded of recycled rubber, such as crumb rubber, though again, other suitable materials may be used. The base is designed to be weighted in accordance with desired specifications for these types of weighted traffic cones. For example, two desired embodiments might be 7 lb. and 10 lb., respectively. The assembly of cone body 14 and base 12 is adapted to be of a specified assembled height, such as 18, 28, or 36 inches, or other desired height. One particular advantage of the inventive cone assembly is that the base 12 comprises 80% of the weight of the cone, while the body or stem 14 is only 20% of the weight of the cone. In state of the art polyvinylchloride (PVC) cones, the base is typically only 60% of the total weight of the assembly. Thus, there is a substantial stability advantage in the inventive cone assembly.

Figure 4:
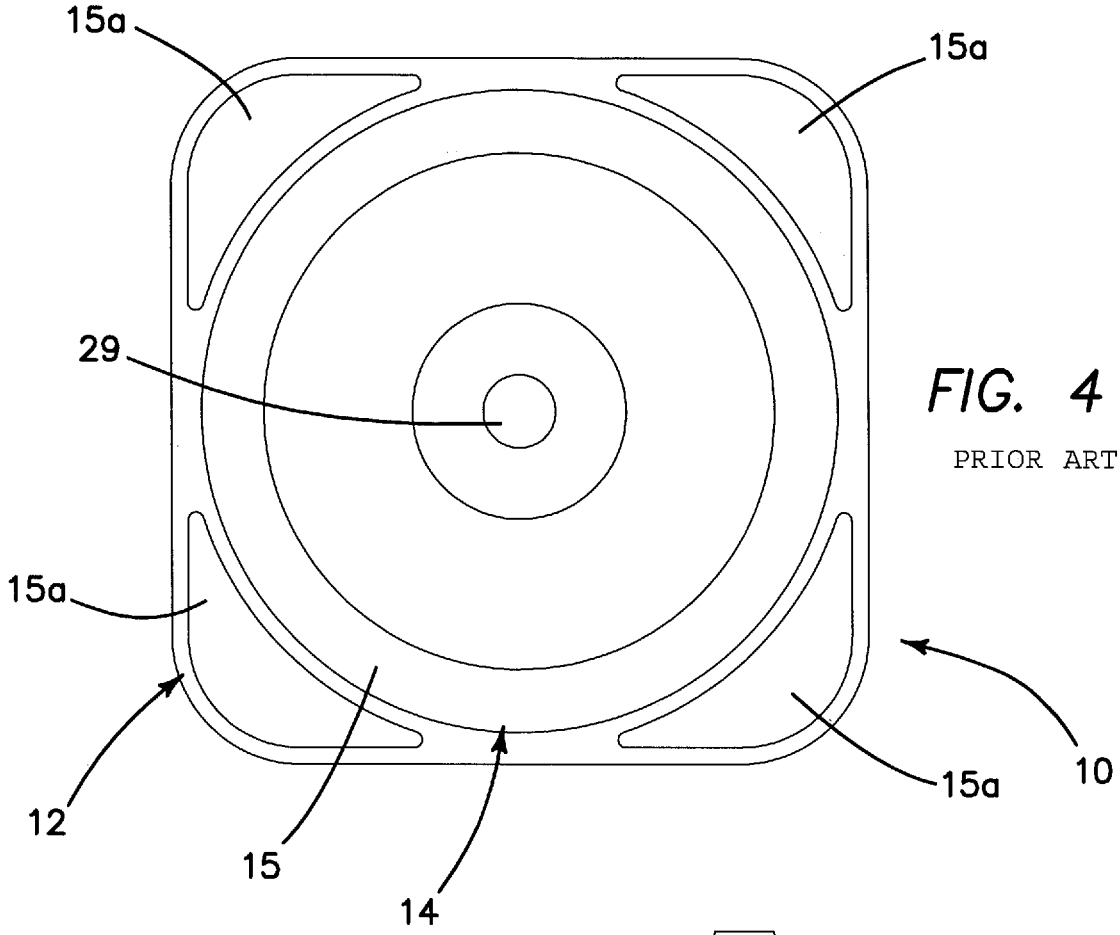
FIG. 4 PRIOR ART
FIG. 4 is a bottom view of the prior art traffic cone of FIGS. 1-3.
Figure 5:
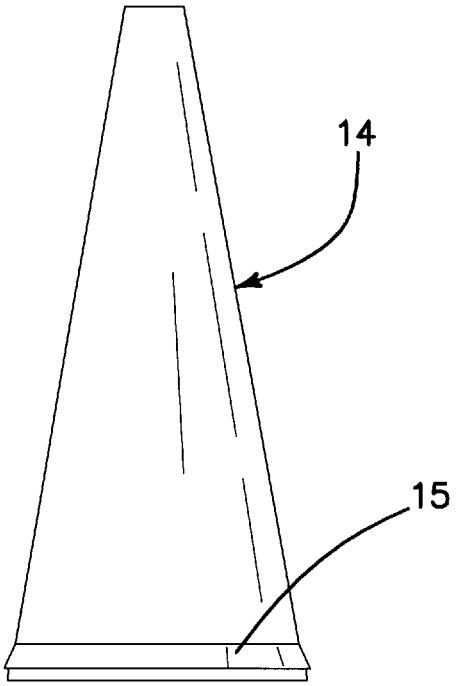
FIG. 5 PRIOR ART
FIG. 5 is a side view of the body of the prior art traffic cone of FIGS. 1-4.

A flange 15 around the bottom of the conical marker body 14 is illustrated in FIGS. 4 and 5. This flange 15 controls the thickness of the base at its connection to the marker body and ensures that base feet 15*a* of the base 12 are always in contact with the ground. Another important feature is the addition of small locking and sizing diamonds around the circumference of the conical body. These diamonds compensate for base molding, dimensional variations, and assist in keeping the base and body rotationally secured in place, while also allowing the cone assembly to easily be separated into two pieces when desired.

The sign 3 is also molded of a suitable plastic material, such as LDPE (Low Density Polyethylene). The sign 3 comprises an outer frame 17 having a first thickness, and a flat, smooth panel portion or face 19, defined by the outer frame 17, for receiving a message, symbol, or other item to be displayed to the public. The panel portion 19 has a thickness less than that of the outer frame 17. In some embodiments, there is a similar or identical opposite face 19.

On a lower end of each sign 3 is a mounting post 21 for securing the traffic sign 3 to the cone assembly 10. The mounting post 21 has a lower opening 23 which is sized and adapted to be secured to a top end 25 of the cone 10. To secure the sign to the cone, the opening 23 is disposed over the top end 25 of the cone and the sign is permitted to settle downwardly until a series of circumferentially disposed molded protrusions 27 engage the side wall of the marker body 14, creating a secure interfering fit between the mounting post 21 and the cone 10. Other suitable securing means may be used instead, such as a post on the lower end of the sign 3 which may be inserted into an aperture 29 in the top end 25 of the cone (FIG. 2).

A handle 31 is molded into the frame 17 of the sign 3 on a top end thereof.

Figures 6, 7:
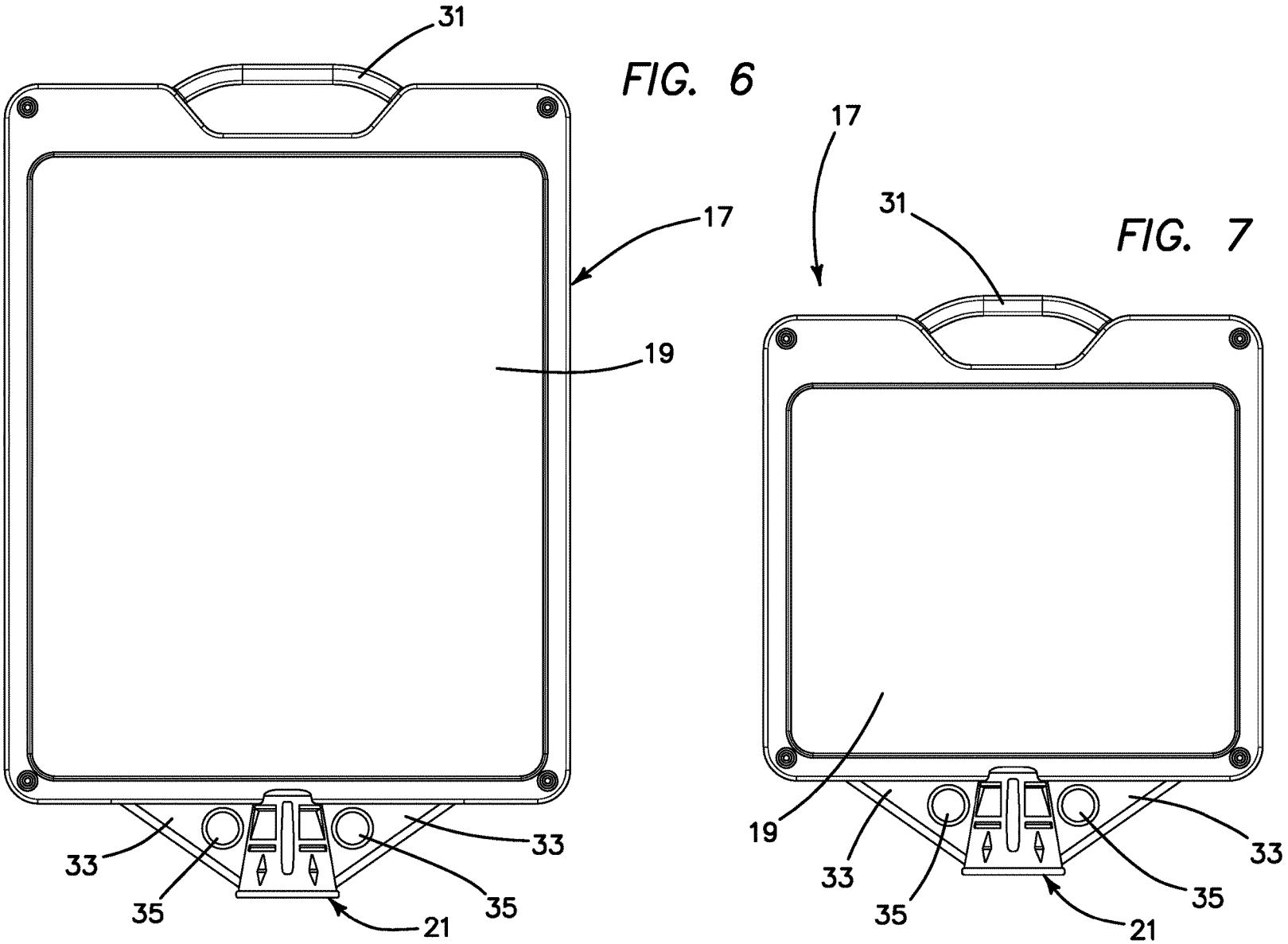
FIG. 6 is a front view of a sign constructed in accordance with the principles of the present invention.
FIG. 7 is a front view of a modified embodiment of a sign constructed in accordance with the principles of the present invention.
Figure 8:
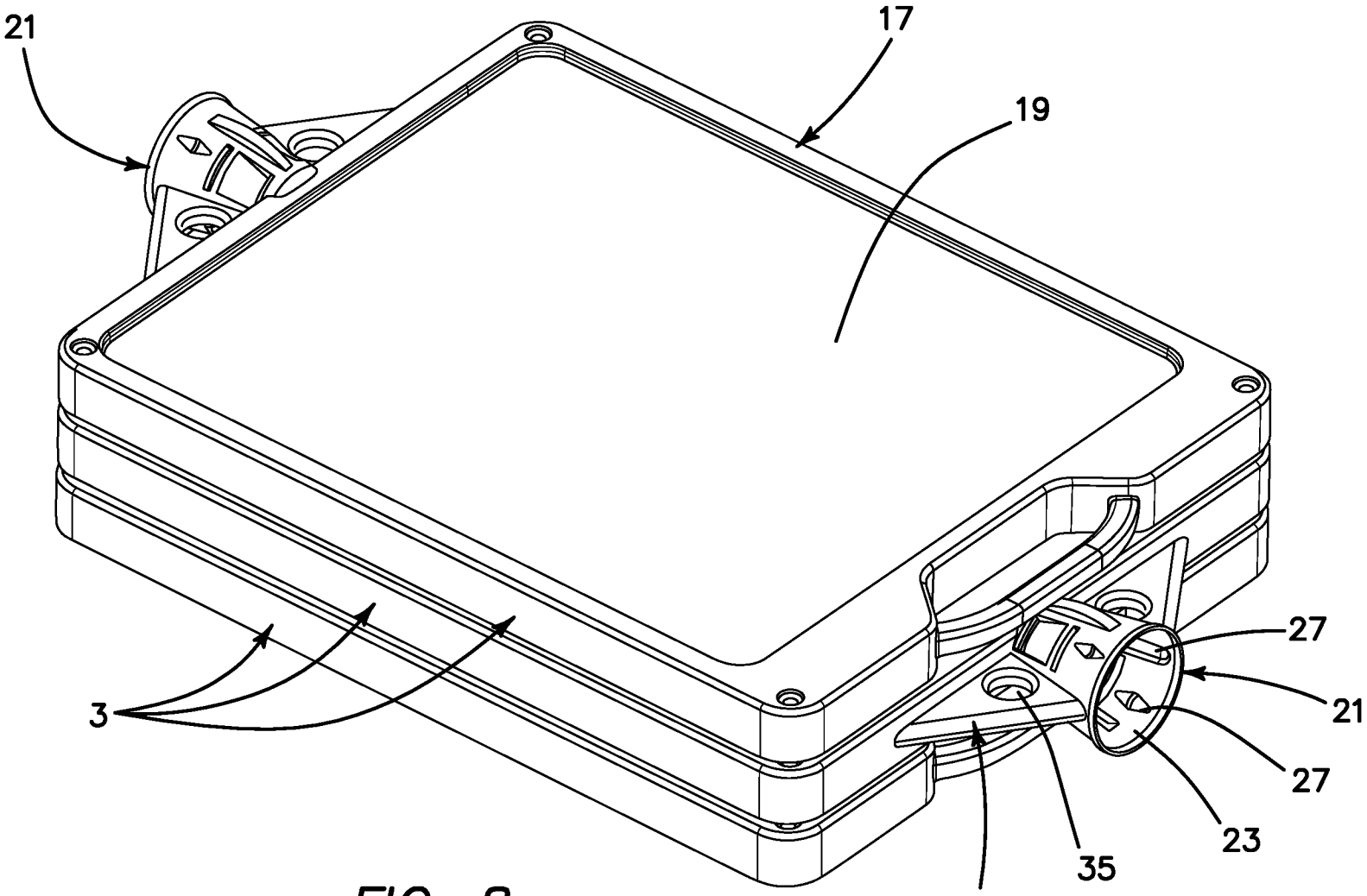
FIG. 8 is an isometric view of a plurality of signs constructed in accordance with the principles of the present invention, in a stacked orientation.
Figure 9:
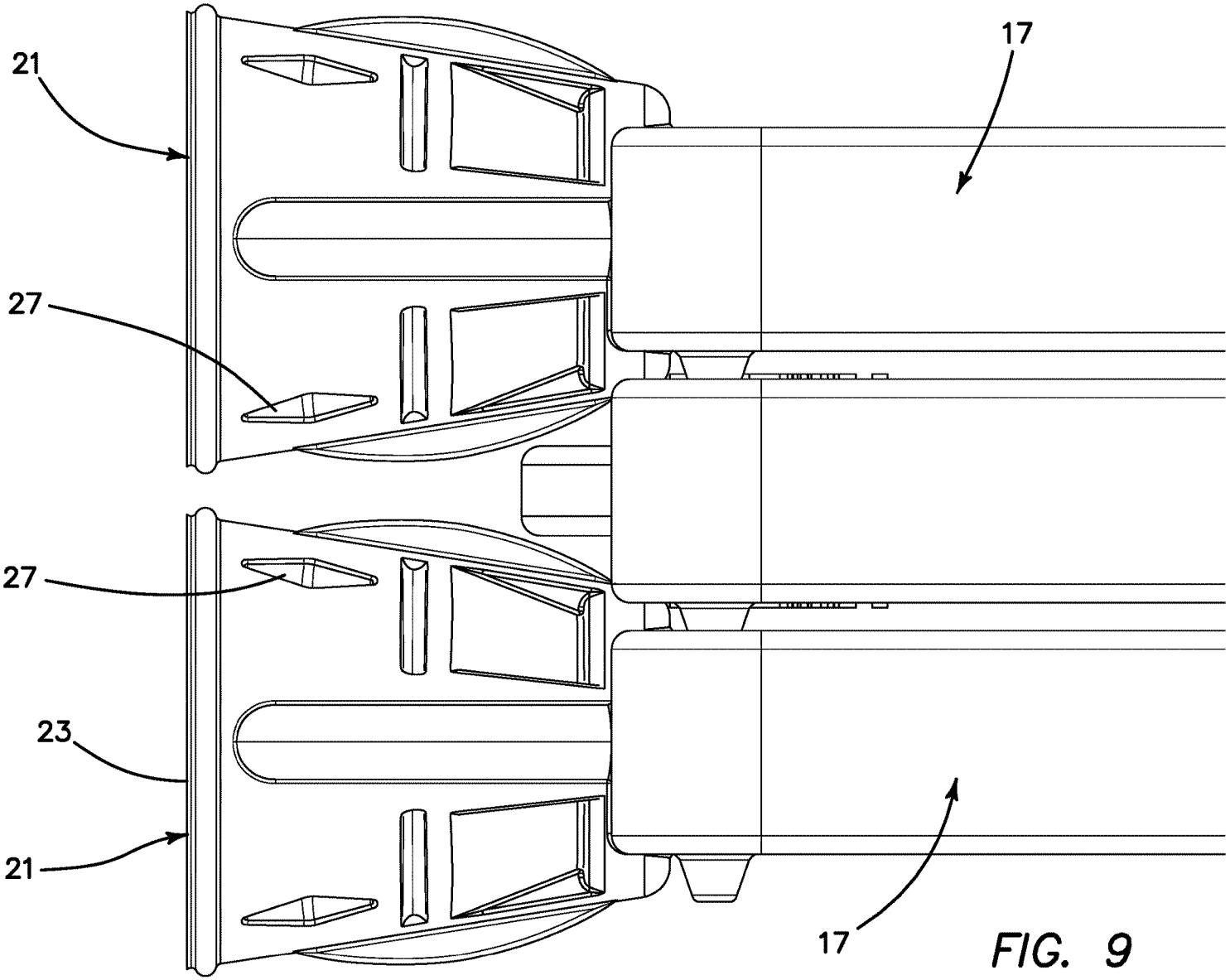
FIG. 9 is a side view of the stacked signs shown in FIG. 8.
Figure 10:
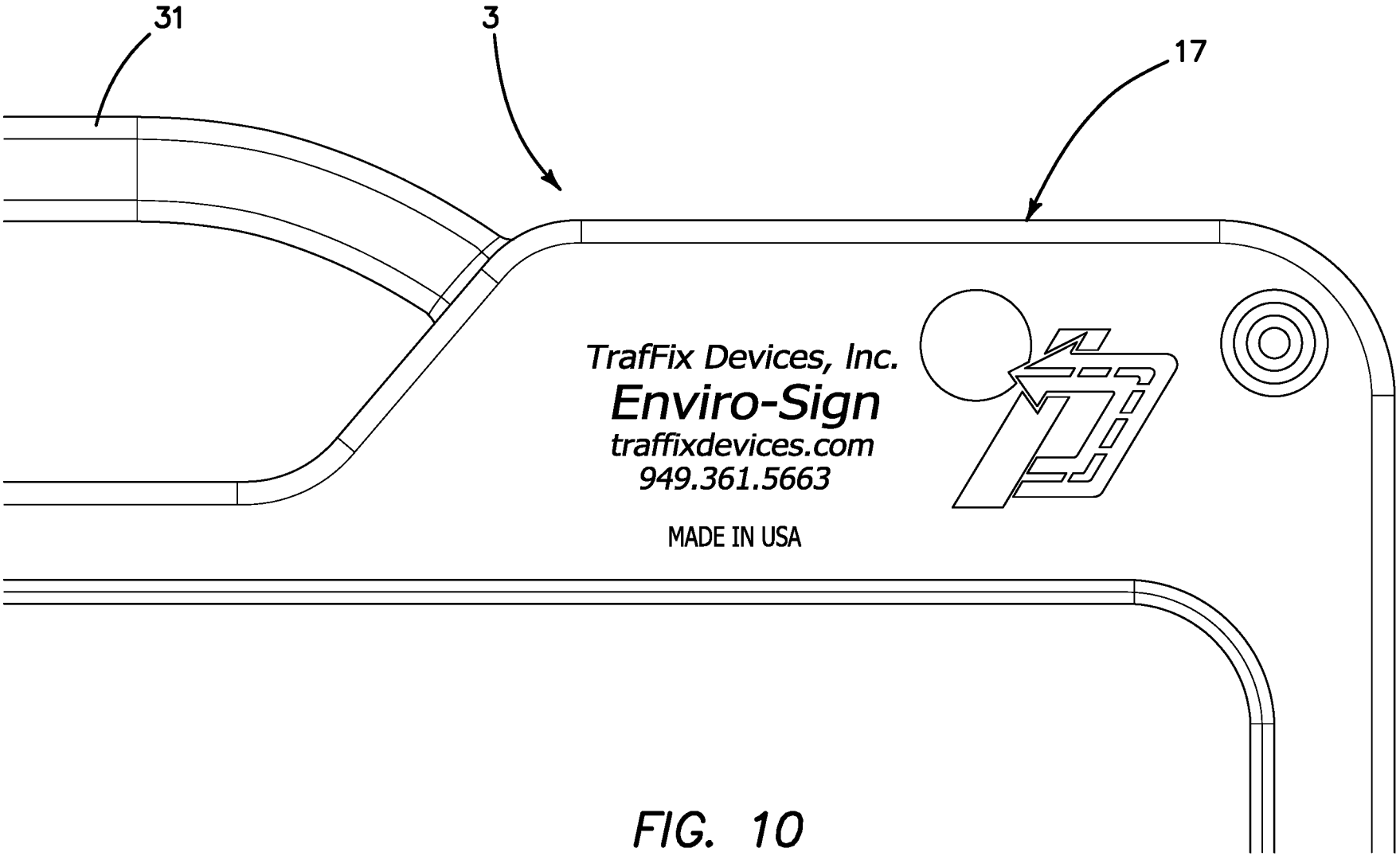
FIG. 10 is a plan view of a top portion of a sign constructed in accordance with the present invention.

FIGS. 6 and 7 illustrate two different embodiments, which are substantially identical to one another except for their size.

Molded brace members 33 connect the frame 17 to the mounting post 21. Within each brace member 33 is disposed a mounting aperture 35, which may be used to mount a flashing light or other useful device, as desired.

Figure 14:
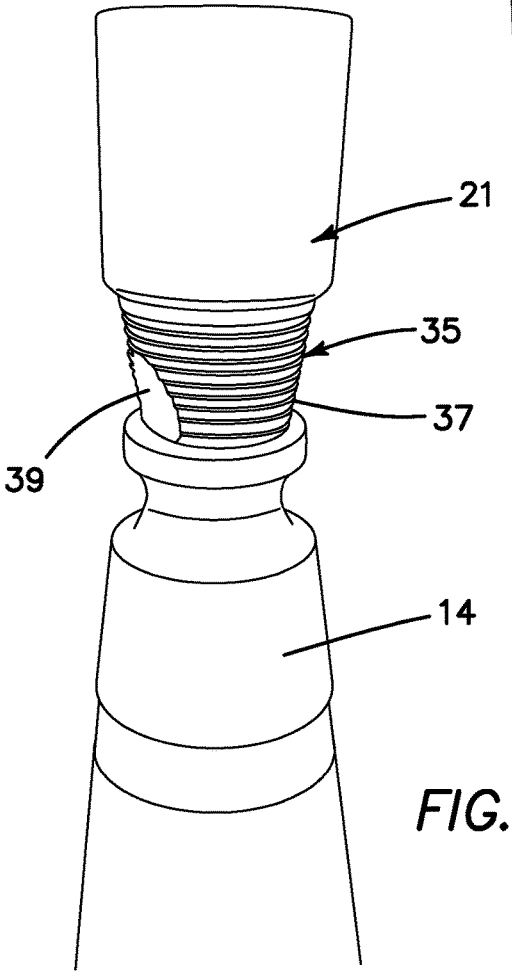
FIG. 14 is a view similar to FIG. 13 showing a tapered conic plug on the sign after it has been inserted into the top of the cone.
Figure 13:
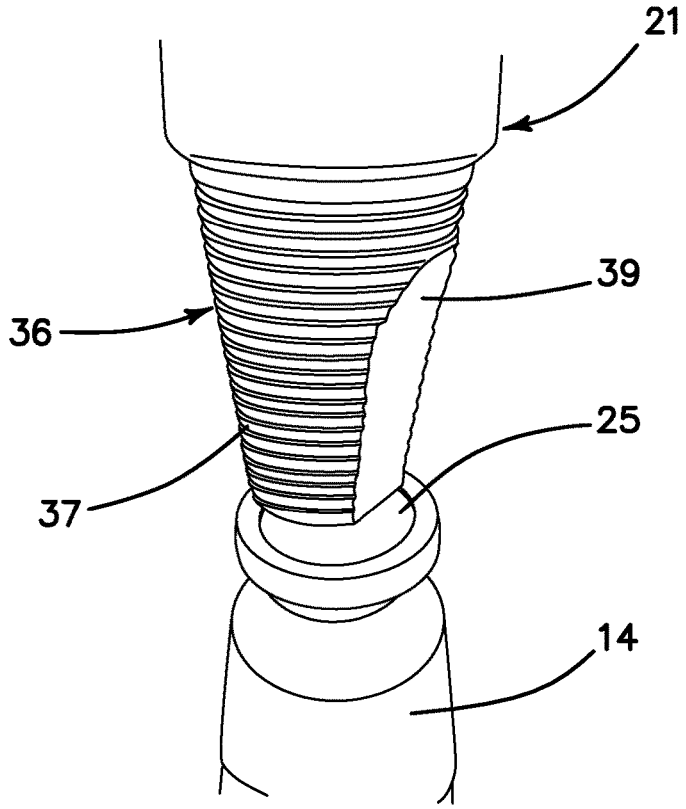
FIG. 13 is a view of another modified embodiment of the present invention.

In FIGS. 13 and 14 there is illustrated a modified exemplary embodiment of the mounting post 21 of the sign assembly. In this embodiment, the mounting post 21 comprises a tapered plug 36 at its lower end, wherein the plug has teeth 37, such as circumferential angled teeth, as shown. Portions of the toothed section 37 of the tapered plug 36 comprise one or more flats or flattened regions 39. As illustrated, these flattened regions or flats 39 extend through a height of 2-10 teeth, and around a circumference of 10-45 degrees, wherein the teeth 37 in the flattened region(s) have been removed or ground away, as shown, though design variances are within the scope of the invention.

Figure 12:
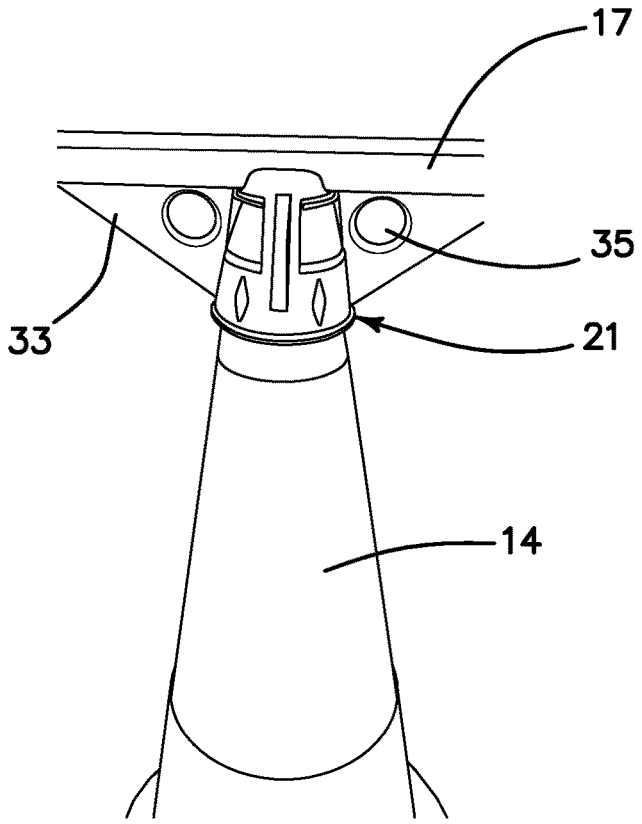
FIG. 12 is an enlarged view of the attachment between the sign and the cone.

Whereas in the prior embodiments, the sign connection snaps over the top of the cone (see FIGS. 1 and 12, for example), in the embodiment of FIGS. 13 and 14 the sign is attached to the cone by insertion of the tapered plug 36 into the open top end 25 of the cone, as shown in FIG. 14. The toothed tapered plug is preferably conic, and the teeth 37 function to better engage the tapered plug within the top of the cone. The flats 39 function to deform and distort the top of the cone when the plug 35 is inserted, thereby making the sign resistant to rotation relative to the cone and thus holding orientation of the sign panel.

This embodiment may otherwise be constructed as shown in FIGS. 1 and 6-12, wherein the sign portion is constructed similarly except for the usage of modified mounting post 21, including tapered plug 36. This embodiment, for example, would still include outer frame 17, panel portion 19, handle 31, molded brace members 33 and mounting apertures 35.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A sign system for displaying warning or informational messages, comprising:

a sign portion having an outer frame defining a panel on which may be displayed an informational or warning message;

a mounting post extending downwardly from a bottom portion of the outer frame, and integrally joined to the bottom portion of the outer frame, for securing the sign portion to a top end of a traffic marker; and a plurality of protrusions disposed about a periphery of the mounting post, which are adapted to engage a portion of a marker body side wall on the traffic marker for securing the sign portion to the traffic marker, wherein the plurality of protrusions are adapted to create a secure interfering fit between the mounting post and the traffic marker when the plurality of protrusions engage the marker body side wall.

2. The sign system as recited in claim 1, and further comprising a plurality of brace members integrally connecting the outer frame to the mounting post, the brace members each having a mounting aperture disposed therein.

3. The sign system as recited in claim 1, and further comprising a handle molded into a top portion of the outer frame.

4. The sign system as recited in claim 1, wherein the sign portion comprises molded plastic.

5. The sign system as recited in claim 4, wherein the molded plastic comprises low density polyethylene.

6. The sign system as recited in claim 1, wherein the mounting post comprises a lower opening.

7. The sign system as recited in claim 6, wherein the lower opening of the mounting post is adapted to slide over the top end of the traffic marker to secure the sign portion to the traffic marker.

8. The sign system as recited in claim 7, wherein the mounting post has a circumferential periphery defining the lower opening, and is generally conically shaped such that the mounting post has a greater diameter at its lower end than at an upper end thereof, the plurality of protrusions extending about the circumferential periphery of the mounting post and protruding inwardly from the circumferential periphery, the inwardly protruding protrusions interferingly engaging with the side marker body wall at the top end of the traffic marker as the mounting post is slid downwardly over the traffic marker to secure the sign portion in place on the traffic marker.

9. The sign system as recited in claim 1, wherein the mounting post comprises a tapered plug, having a greater diameter at an upper end and a lesser diameter at a lower end thereof.

10. The sign system as recited in claim 9, wherein the plurality of protrusions comprise a plurality of spaced circumferential teeth disposed about the tapered plug, and the tapered plug is conic.

11. The sign system as recited in claim 10, wherein the spaced circumferential teeth comprise circumferential angled teeth.

12. The sign system as recited in claim 10, and further comprising a flattened portion disposed across a plurality of the spaced circumferential teeth, the flattened portion enhancing a secure interfering fit between the tapered plug and the traffic marker.

13. The sign system as recited in claim 12, wherein the flattened portion comprises a plurality of flattened portions.

14. The sign system as recited in claim 13, wherein the plurality of flattened portions extend through a height of 2-10 teeth and around a circumference of the tapered plug of 10-45 degrees.

15. A sign system for displaying warning or informational messages, comprising:

a sign portion having an outer frame defining a panel on which may be displayed an informational or warning message;

a traffic marker having a top end and a marker body side wall;

a mounting post integrally joined to and extending downwardly from a bottom portion of the outer frame which secures the sign portion to the top end of the traffic marker; and a plurality of protrusions disposed about a periphery of the mounting post, which engage a portion of the vertically disposed marker body wall and secure the sign portion to the traffic marker, the plurality of protrusions creating a secure interfering fit between the mounting post and the traffic marker when the plurality of protrusions engage the marker body side wall.

16. The sign system as recited in claim 15, and further comprising a plurality of brace members integrally connecting the outer frame to the mounting post, the brace members each having a mounting aperture disposed therein.

17. The sign system as recited in claim 15, and further comprising a handle molded into a top portion of the outer frame.

18. The sign system as recited in claim 15, wherein the sign portion comprises molded plastic.

19. The sign system as recited in claim 18, wherein the molded plastic comprises low density polyethylene.

20. The sign system as recited in claim 15, wherein the mounting post comprises a lower opening.

21. The sign system as recited in claim 20, wherein the lower opening of the mounting post is slid over the top end of the traffic marker to secure the sign portion to the traffic marker.

22. The sign system as recited in claim 21, wherein the mounting post has a circumferential periphery defining the lower opening, and is generally conically shaped such that the mounting post has a greater diameter at its lower end than at an upper end thereof, the plurality of protrusions extending about the circumferential periphery of the mounting post and protruding inwardly from the circumferential periphery, the inwardly protruding protrusions interferingly engaging with the side marker body wall at the top end of the traffic marker as the mounting post is slid downwardly over the traffic marker to secure the sign portion in place on the traffic marker.

23. The sign system as recited in claim 15, wherein the mounting post comprises a tapered plug, having a greater diameter at an upper end and a lesser diameter at a lower end thereof.

24. The sign system as recited in claim 23, wherein the plurality of protrusions comprise a plurality of spaced circumferential teeth disposed about the tapered plug, and the tapered plug is conic.

25. The sign system as recited in claim 24, wherein the spaced circumferential teeth comprise circumferential angled teeth.

26. The sign system as recited in claim 24, and further comprising a flattened portion disposed across a plurality of the spaced circumferential teeth, the flattened portion enhancing a secure interfering fit between the tapered plug and the traffic marker.

27. The sign system as recited in claim 26, wherein the flattened portion comprises a plurality of flattened portions.

28. The sign system as recited in claim 27, wherein the plurality of flattened portions extend through a height of 2-10 teeth and around a circumference of the tapered plug of 10-45 degrees.

* * * * *